United States Patent [19]

Takinori et al.

[11] Patent Number: 4,838,807

[45] Date of Patent: Jun. 13, 1989

[54] ELECTRICAL CONNECTOR LATCHING MECHANISM

[75] Inventors: Sasaki Takinori, Hino; Noriaki Takenaka, Tokyo; Akira Kawaguchi, Tachikawa; Yukiharu Tayama, Tokyo, all of Japan

[73] Assignee: AMP Incorporated, Harrisburg, Pa.

[21] Appl. No.: 160,978

[22] Filed: Feb. 26, 1988

[30] Foreign Application Priority Data

Mar. 28, 1987 [JP] Japan ..... 62-075773

[51] Int. Cl.[4] ..... H01R 13/62

[52] U.S. Cl. ..... 439/347

[58] Field of Search ..... 439/345, 347

[56] References Cited

U.S. PATENT DOCUMENTS

| | | | |
|---|---|---|---|
| 4,386,243 | 5/1983 | De Luca et al. | 439/347 X |
| 4,454,382 | 6/1984 | Borne et al. | 439/347 X |
| 4,501,460 | 2/1985 | Sisler | 439/347 X |

FOREIGN PATENT DOCUMENTS

| | | | |
|---|---|---|---|
| 18552 | 11/1980 | European Pat. Off. | 439/347 |
| 3516040 | 11/1985 | Fed. Rep. of Germany | 439/347 |
| 1442837 | 7/1976 | United Kingdom | 439/347 |

OTHER PUBLICATIONS

AMP Case No. 4859 corresponding to British Pat. No. 2071928, granted Feb. 8, 1984.

*Primary Examiner*—William Briggs

*Attorney, Agent, or Firm*—David L. Smith; William B. Noll

[57] ABSTRACT

A latching mechanism to latch matable electrical connectors together comprises first and second electrical connectors (10,20) for matable engagement with one another, the first connector (20) having a projection (21) engageable with a tapered section (17) of a slide (15) extending along a wall of a housing (11) of the second connector (10) when the first connector is inserted into an opening (12) of the second connector (10), the slide (15) being biased in one direction by a spring (14). The slide (15) is moved in another direction upon further insertion of the first connector (20) into the opening (12) until the projection (21) moves beyond the tapered section (17) into a recess (18) whereupon the slide (15) moves back to the one direction under the influence of the spring (14) thereby latching the connectors (10,20) together.

4 Claims, 3 Drawing Sheets

ELECTRICAL CONNECTOR LATCHING MECHANISM

FIELD OF THE INVENTION

The present invention relates to an electrical connector latching mechanism for latching matable electrical connectors in electrical engagement.

BACKGROUND OF THE INVENTION

Various types of electrical connectors for electrically connecting electric wires and the like, including those for single wires and multiples-wires, are known. Most of such connectors are of the type comprising matable connectors having therein connectable electrical contacts. Such connectors have been used not only for connecting wires but also for connecting wires with a printed circuit board.

These connectors, when used for connecting electric wires and subjected to a large external force, may become loose or be disconnected thereby resulting in disruption of electrical connections in essential electronic equipment.

SUMMARY OF THE INVENTION

The present invention is intended to resolve such loose or disconnection problems caused by external forces by providing a pair of electrical connectors with a latching mechanism for maintaing them in a latched condition. To do this a latching mechanism is constructed for a first connector and a second connector which has an opening for accommodating the first connector. The latching mechanism comprises a slider along a side wall of a housing of the second connector which can slide perpendicularly to the direction of inserting the first connector into the opening under the influence of a biasing force acting in one direction. A protrusion protrudes from a side of the first connector and faces the slider when the first connector is inserted in the opening. The slider includes a tapered portion and a recess so that as the first connector is inserted into the opening, the protrusion of the first connector engages with the tapered portion to move the slider in the direction reverse to the one direction until the first connector is inserted a predetermined distance in the opening. When the protrusion moves beyond the tapered portion, the protrusion is disposed in the recess thereby permitting the slider to move back under the influence of the biasing force. Thus, the protrusion is kept in the recess thereby latching the connectors together.

As the first connector is inserted into the opening of the second connector enabling the first electrical contacts thereof to be electrically connected with the second electrical contacts accommodated in the second connector, the protrusion of the first connector of the latching mechanism will engage with the tapered portion of the slider of the second connector and move the slider in the direction reverse to the biasing direction (i.e. opposite to the one direction), and, when the insertion of the first connector into the opening exceeds a predetermined distance, the protrusion will move beyond the tapered portion and be disposed in the recess of the slider. Then the slider will be allowed to move laterally in the one direction by the biasing force, so that the protrusion in the recess will be latched therein. Because of this latching of the protrusion in the recess, the first connector will be latched in the opening of the second connector, so that the two connectors will also be latched securely together and will not be disconnected even when external forces are applied thereagainst.

BRIEF DESCRIPTION OF THE DRAWINGS

The invention will now be described by way of example with reference to the following detailed description of the invention in conjunction with the accompanying drawings of which.

DETAILED DESCRIPTION OF THE INVENTION

Figure 1:
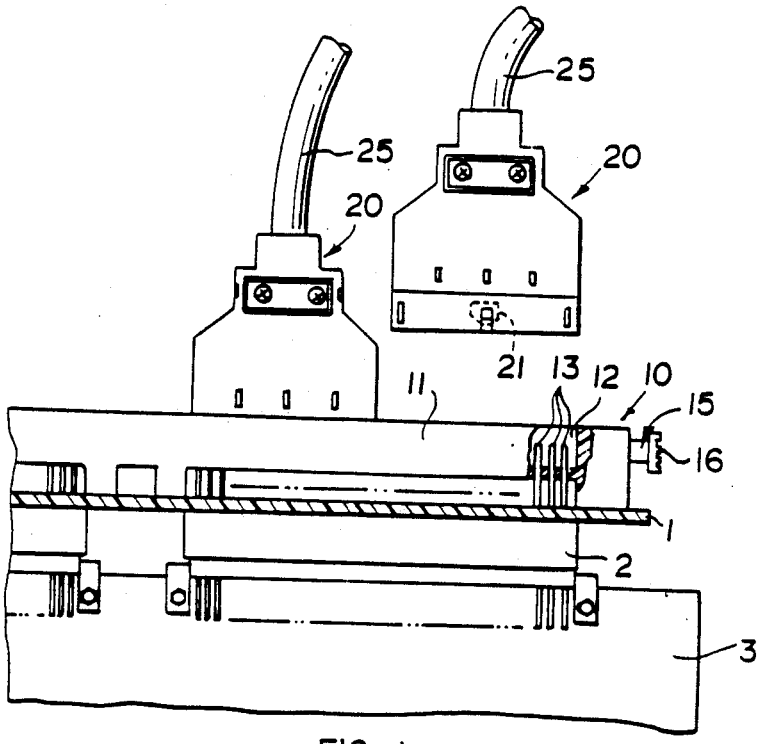
FIG. 1 is a front elevational view of electrical connectors having a latching mechanism in accordance with the invention showing one pair of connectors in a latched position with the one connector of the other pair being exploded from the second connector.

The electrical connector, as shown in FIG. 1, comprises a first electrical connector 20 electrically connected with one end of an electrical cable 25 having a multiplicity of insulated electrical wires therein, and a second electrical connector 10 to be electrically connected with first connector 20. The second connector 10 is shown to be secured to a printed circuit board 1 which is in turn electrically connected with a mother board 3 via a header 2. Housing 11 of second connector 10 is formed with an opening 12 which opens outwardly to accommodate first connector 20. In this embodiment, a multiplicity of first connectors 20 can be connected with a single second connector 10. It should be understood however that the latching mechanism of this invention is not limited to connecting such multiple first connectors, but it may be used equally well for the connection between single first and second connectors.

Figure 2:
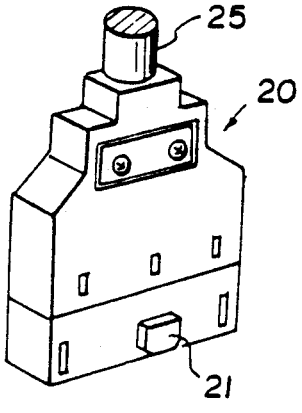
FIG. 2 is a perspective view of the first connector.

The first connector 20 has secured therein a multiplicity of first electrical contacts (not shown) to which respective electrical wires of the cable 25 are connected. As viewed in FIG. 1, a protrusion 21 shown in phantom is located on the lower portion of the rear side of the first connector 20 for use in conjunction with the latching mechanism. Projection 21 is clearly shown on the front side of connector 20, as viewed in FIG. 2.

Second connector 10 comprises an insulating housing 11, a multiplicity of second electrical contacts 13 which are firmly embedded in printed circuit board 1 and protrude into opening 12 of housing 11, and a slider 15 which is mounted along an inner surface of opening 12 of housing 11 and is laterally movable to the right and left as viewed in FIG. 1, so that it faces protrusion 21 when first connector 20 is inserted into opening 12. Thus, when first connector 20 is inserted in opening 12 of second connector 10, corresponding contacts of both the connectors are mutually connected, and hence the electric wires of the cable 25 are electrically connected with respective conductive paths or areas of board 1.

Slider 15 has a tapered portion 17 to be engaged by protrusion 21 of first connector 20 when connector 20 is inserted in opening 12 and to be disposed in a recess 18 of slider 15, as described below with reference to FIGS.

Figure 3A:
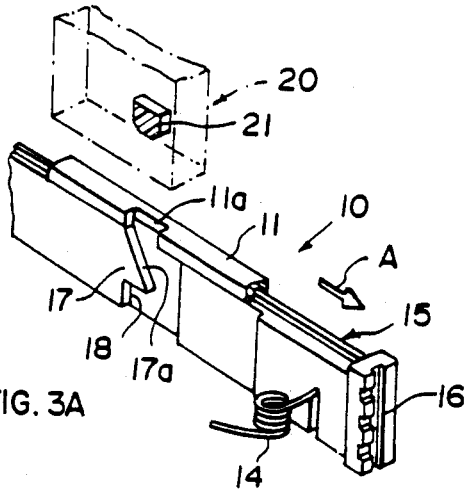
FIGS. 3A through 3E are perspective views showing the operation of the slider and the protrusion constituting the latching mechanism.

3A through 3E. Slider 15 is supported along an inner surface of opening 12 by housing 11 so that it can freely slide in the transverse direction relative to housing 11. As shown in FIG. 3A, a recess 11*a* is located at the top of housing 11 for allowing protrusion 21 of first connector 20 to pass therethrough. Beneath recess 11*a*, a tapered portion 17 having a tapered surface 17*a* is located on slider 15, and a recess 18 is positioned in slider 15 below tapered portion 17. Recess 18 receives protrusion 21 when first connector 21 and second connector 10 are mated. Slider 15 is biased in the direction of arrow A by a spring 14 mounted inside housing 11. It is to be noted that the ring end of slider 15 projects out of housing 11 and has a portion 16.

Figure 3B:
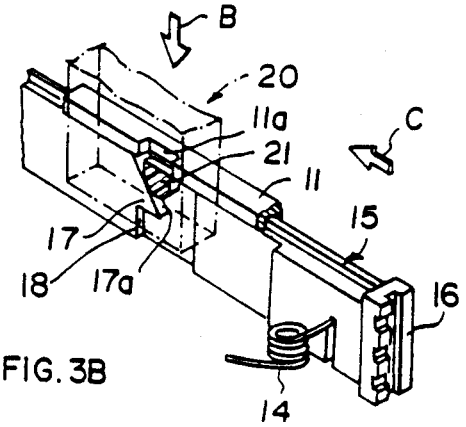
Figure 3E:
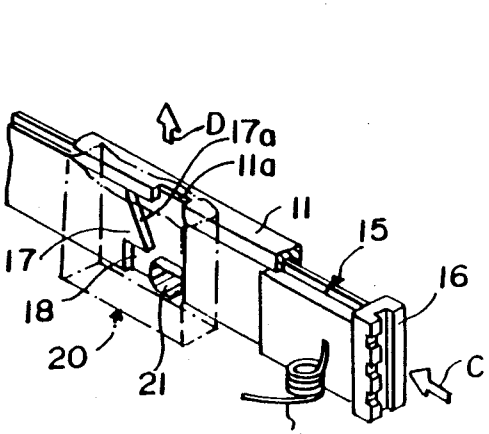
Figure 3D:
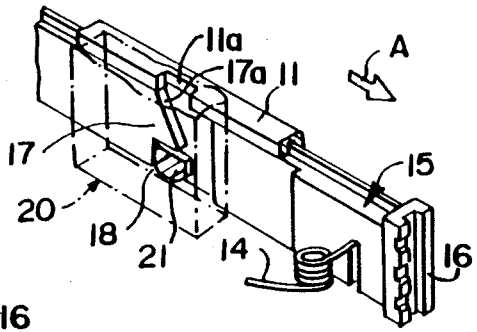
Figure 3C:
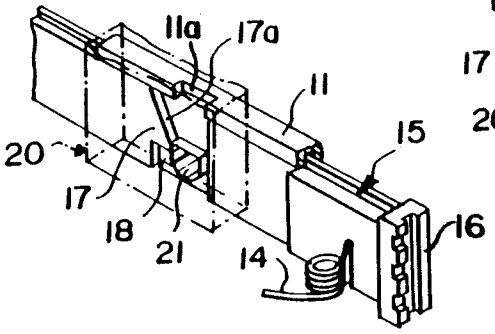

The operation of first connector 20 being inserted into opening 12 of second connector 10 having slider 15 therein will now be described. As shown in FIG. 3B, when first connector 20 is inserted into opening 12 in the direction indicated by arrow B, protrusion 21 passes through recess 11*a* and engages tapered surface 17*a* of slider 15. Hence, when connector 20 is inserted further into opening 12, slider 15 is moved to the left (in the direction indicated by arrow C), resisting the biasing force exerted thereto by spring 14. Further insertion of first connector 20 into opening 12 causes protrusion 21 to move along tapered surface 17*a*, as shown in FIG. 3C and then moved beyond tapered portion 17 and disposed in recess 18, as shown in FIG. 3D. Then slider 15 is moved again to the right (as indicated by arrow A) by the biasing force of spring 14 thereby causing the protrusion 21 to be retained in the recess 18 as shown in FIG. 3D. Because of the retention of protrusion 21 in recess 18, first connector 20 and second connector 10 are maintained in a latched condition and are prevented from being disconnected even under the influence of external force. However, it should be understood that, by pushing onto portion 16 at the right end of slider 15 (as indicated by arrow C) the biasing force of spring 14 may be overcome to move slider 15 to the left, so that protrusion 21 can be removed from the recess 18 as shown in FIG. 3E, such as when first connector 20 is disconnected from second connector 10. Hence, first connector 20 can be disconnected from second connector 10 if slider 15 is moved in the direction of arrow C such that protrusion 21 clears the narrowest region limited by tapered surface 17*a* and first connector 20 is moved in the direction of arrow D.

Figure 4:
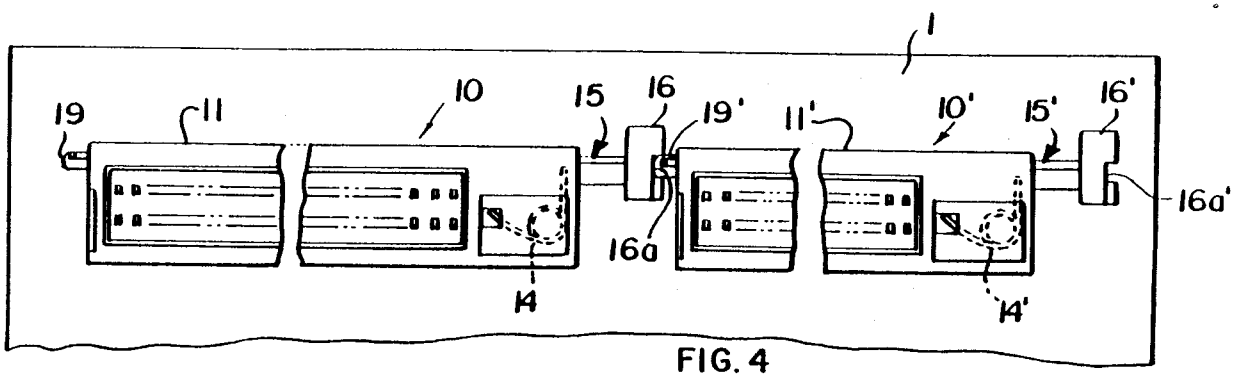
FIG. 4 is a top plan view showing a multiplicity of the second connectors arranged on a printed circuit board.

FIG. 4 shows two second connectors 10,10' arranged on printed circuit board 1. Portions 16,16' and convex portions 19,19' are located respectively at the right ends and the left ends of sliders 15,15' which project outwardly from housings 11,11'. Therefore, in arranging a plurality of connectors 10,10' on board 1 as shown in FIG. 4, it is preferable to have them arranged in series with the left convex portion 19' of slider 15' of one connector 10' inserted in the groove 16*a* in portion 16 of slider 15 of another connector 10, so that, if portion 16' of one connector 10' at the far right end is pushed, all sliders 15,15' can be moved. In this manner, the connectors may be arranged closely; consequently, the connectors can be mounted on the board in high density.

According to the present invention described above, when a first connector is inserted into the opening of a second connector to connect first contacts with second contacts accommodated in the first and the second connectors, respectively, a protrusion of the first connector engages with a tapered portion of a slider of the second connector and causes the slider to move from a biased position (i.e. to move in the direction opposite to the direction of the biasing force). This allows the protrusion to pass beyond the tapered portion and be disposed in a recess of the slider when the first connector is further inserted into the opening a predetermined distance, whereby the slider is moved back in the biasing direction to retain the protrusion therein, thereby latching the first connector in the opening of the second connector and keeping them connected even under the influence of external forces. A single slider in a second connector may accommodate one or more first connectors. A plurality of second connectors may be located adjacent each other on a printed circuit board such that the sliders interengage such that if the slider on a second connector is moved laterally, the slider on other second connectors are also moved laterally.

We claim:

1. An electrical connector for latchable engagement with a complementary electrical connector, comprising;

a dielectric housing having electrical contacts disposed therein and including an opening in which contact sections of the electrical contacts are positioned;

slide means movably mounted within said opening of said housing along an inside surface of a side wall of said housing and being movable laterally relative to the side wall, said movable slide means having a slide-engaging section and a receiving area; and spring means engaging said slide means biasing said slide means to a latching position so that when slide-operating means of the complementary connector engages said slide-engaging section during the insertion of the complementary connector into said opening of the housing, said slide means is moved in a direction opposite to the latching position against the bias of said spring means until the slide-operating means moves beyond the slide-engaging section into said receiving area with said contact sections electrically engaging complementary contact members of the complementary connector whereupon said slide means is moved back under the bias of said spring means to the latching position thereby latching the connector connectors together.

2. An electrical connector as claimed in claim 1, wherein said slide-engaging section comprises a tapered section.

3. An electrical connector as claimed in claim 1, wherein said receiving area is a recess.

4. An electrical connector as claimed in claim 1, wherein said slide means includes means to move it opposite to the latching position to enable the slide-operating means of the complementary connector to be removed from the receiving area so that the connectors can be disconnected.

* * * * *

UNITED STATES PATENT AND TRADEMARK OFFICE

CERTIFICATE OF CORRECTION

PATENT NO. : 4,838,807

DATED : June 13, 1989

INVENTOR(S) : Takinori Sasaki, et al

It is certified that error appears in the above-identified patent and that said Letters Patent is hereby corrected as shown below:

On the title page, under item (19) "Takinori et al" should read --Sasaki et al--.

The name of the first inventor should be changed from "Sasaki Takinori" --Takinori Sasaki--.

Column 4, claim 1, line 50, change "connector" to --connected--.

Signed and Sealed this

Twenty-seventh Day of March, 1990

*Attest:*

JEFFREY M. SAMUELS

*Attesting Officer*

*Acting Commissioner of Patents and Trademarks*